US012024969B2

(12) United States Patent
Remington

(10) Patent No.: US 12,024,969 B2
(45) Date of Patent: Jul. 2, 2024

(54) HIGH VELOCITY AND PRESSURE BOP RAM SEAL, RAM BODY, AND RAM SEAL ASSEMBLY

(71) Applicant: Bellofram Acquisition II, LLC, Newell, WV (US)

(72) Inventor: Tyler Remington, Moore, OK (US)

(73) Assignee: Bellofram Acquisition II, LLC, Newell, WV (US)

( * ) Notice: Subject to any disclaimer, the term of this patent is extended or adjusted under 35 U.S.C. 154(b) by 0 days.

(21) Appl. No.: 17/706,520

(22) Filed: Mar. 28, 2022

(65) Prior Publication Data

US 2022/0307339 A1 Sep. 29, 2022

Related U.S. Application Data

(60) Provisional application No. 63/167,614, filed on Mar. 29, 2021.

(51) Int. Cl.
*E21B 33/06* (2006.01)

(52) U.S. Cl.
CPC ..... *E21B 33/062* (2013.01); *E21B 2200/01* (2020.05)

(58) Field of Classification Search
CPC ..... E21B 33/06; E21B 33/061; E21B 33/062
USPC ..... 277/324, 325
See application file for complete search history.

(56) References Cited

U.S. PATENT DOCUMENTS 2,593,793 A * 4/1952 Rector ..... E21B 33/062 251/1.3
3,692,316 A * 9/1972 Bishop ..... E21B 33/062 251/1.3
4,089,532 A * 5/1978 Kamyshnikov ..... E21B 33/062 251/1.3
4,416,441 A * 11/1983 Van Winkle ..... E21B 33/062 251/1.3
4,550,895 A * 11/1985 Shaffer ..... E21B 33/062 251/1.3
4,646,825 A * 3/1987 Van Winkle ..... E21B 33/063 166/55
4,647,002 A * 3/1987 Crutchfield ..... E21B 33/062 251/1.3
4,690,411 A * 9/1987 Van Winkle ..... E21B 33/062 251/1.3

(Continued)

FOREIGN PATENT DOCUMENTS

CA 2 716 430 12/2001
CA 2 942 857 8/2019

OTHER PUBLICATIONS

WSI Publication titled "Heavy Duty Application 500T", publication date unknown.

(Continued)

*Primary Examiner* — Nicholas L Foster
(74) *Attorney, Agent, or Firm* — Lippes Mathias LLP

(57) ABSTRACT

A polished rod blowout preventer (BOP) ram seal is created by installing a rubber seal component onto a movable metal ram block that allows the ram to be opened and closed. The rubber seal is installed into a corresponding groove on the metal ram block or body that allows for compression of the seal between the polished rod, BOP ram housing, and ram bodies. The anti-extrusion features allow for use in high velocity and high-pressure applications. A blind seal embodiment is also disclosed.

17 Claims, 14 Drawing Sheets

(56) References Cited

U.S. PATENT DOCUMENTS

| | | | | |
|---|---|---|---|---|
| 4,930,745 | A * | 6/1990 | Granger | E21B 33/062 251/1.2 |
| 5,044,603 | A * | 9/1991 | Granger | E21B 33/062 251/1.3 |
| 6,719,262 | B2 | 4/2004 | Whitby et al. | |
| 6,739,570 | B2 | 5/2004 | Carlsen | |
| 6,857,634 | B2 | 2/2005 | Araujo | |
| 6,877,712 | B2 | 4/2005 | Wiedemann | |
| 6,955,357 | B2 | 10/2005 | Griffin et al. | |
| 7,017,881 | B2 | 3/2006 | Ward | |
| 7,137,610 | B2 | 11/2006 | Lam | |
| 7,243,713 | B2 | 7/2007 | Isaacks et al. | |
| 7,331,562 | B2 | 2/2008 | Springett | |
| 7,510,002 | B2 | 3/2009 | Brown et al. | |
| 7,552,765 | B2 | 6/2009 | Lam | |
| 7,798,466 | B2 | 9/2010 | Springett et al. | |
| 8,770,541 | B2 | 7/2014 | Wood | |
| 8,783,643 | B2 | 7/2014 | Guo et al. | |
| 8,800,954 | B2 | 8/2014 | Edwards | |
| 8,807,516 | B2 | 8/2014 | Guo et al. | |
| 8,844,898 | B2 | 9/2014 | Weir | |
| 9,010,718 | B2 | 4/2015 | Foote | |
| 9,045,961 | B2 | 6/2015 | Melancon et al. | |
| 9,238,950 | B2 | 1/2016 | Schaeper | |
| 9,243,469 | B2 | 1/2016 | Guo et al. | |
| 10,221,646 | B2 | 3/2019 | Sedens et al. | |
| 10,337,265 | B1 | 7/2019 | le Vann et al. | |
| 10,443,336 | B2 | 10/2019 | Ellison | |
| 2002/0066875 | A1 | 6/2002 | Carlsen | |
| 2004/0066003 | A1 | 4/2004 | Griffin et al. | |
| 2004/0079909 | A1 | 4/2004 | Foster | |
| 2004/0084644 | A1 | 5/2004 | Wiedemann | |
| 2004/0113108 | A1 | 6/2004 | Ward | |
| 2004/0262551 | A1 | 12/2004 | Lam | |
| 2007/0044976 | A1 | 3/2007 | Isaacks et al. | |
| 2007/0175626 | A1 | 8/2007 | Lam | |
| 2008/0265188 | A1 | 10/2008 | Springett et al. | |
| 2009/0050828 | A1 | 2/2009 | Edwards | |
| 2010/0243926 | A1 | 9/2010 | Weir | |
| 2012/0012339 | A1 | 1/2012 | Weir et al. | |
| 2012/0012340 | A1 | 1/2012 | Ensley et al. | |
| 2012/0241663 | A1 | 9/2012 | Wood | |
| 2013/0284953 | A1 | 10/2013 | Brown et al. | |
| 2015/0184481 | A1 | 7/2015 | Painter et al. | |
| 2015/0198003 | A1 | 7/2015 | Schaeper | |
| 2016/0138356 | A1 | 5/2016 | Ellison | |
| 2017/0037695 | A1 | 2/2017 | Sedens et al. | |
| 2017/0058625 | A1 | 3/2017 | Araujo et al. | |
| 2017/0058626 | A1 | 3/2017 | Araujo et al. | |
| 2018/0283126 | A1 | 10/2018 | Haverstad et al. | |
| 2019/0049017 | A1 | 2/2019 | McAdam et al. | |

OTHER PUBLICATIONS

WSI Catalog pp. 16-17 titled "Premier Blow-Out Preventers (BOP)", publication date unknown.

WSI Publication titled "Heavy Duty Application 500T", date unknown.

WSI Catalog pp. 16-17 titled "Premier Blow-Out Preventers (BOP)", Jan. 1, 2017.

Photograph of Snap-Loc Seal, Wellhead Systems Inc., Dec. 2020.

* cited by examiner

HIGH VELOCITY AND PRESSURE BOP RAM SEAL, RAM BODY, AND RAM SEAL ASSEMBLY

CROSS-REFERENCE TO RELATED APPLICATION

The present application claims priority from and benefit of the filing date of U.S. provisional application Ser. No. 63/167,614 filed Mar. 29, 2021, and the entire disclosure of said provisional application is hereby expressly incorporated by reference into the present specification.

BACKGROUND

Polished rod blow out preventers (rod BOPs) are a common piece of equipment that have been used for years to seal off wells when the fluids are not at the planned operational conditions. As oil wells have evolved due to the changing operational conditions, so to have the BOPs needed to change.

The current method of sealing a well consists of a combination of a rubber seal material and a rigid metal body. These designs either involve molding the rubber entirely around the metal body or into a groove on the face and around the outside of the metal body. Previously as the rubber seal component would wear due to extended use, the entire ram assembly would be discarded and replaced. However, due to new environmental and economic concerns, the need for a replaceable rubber seal has developed.

New oil extraction methods are also causing a change in the conditions these BOPs have historically seen. From a combination of hydraulic fracturing and horizontal drilling, existing oil wells can see increased oil pressure that they were not initially designed to handle.

With the need for a replaceable seal and new oil extraction methods arose new problem, as rams were closed the annulus between the polished rod and BOP body would decrease. The decrease in the area causes and increase in the velocity of the fluid as it continues to flow at high pressure. This combination of high velocity and high pressure often would cause the seals to be ripped out of the groove on the metal block. Examples of known seals and ram seal assemblies that seek to address these concerns are disclosed in in U.S. Pat. No. 10,221,646 and Canadian Patent No. 2,716,430. These prior seals and ram seal assemblies have been found to be sub-optimal and a need has been identified for a new and improved seal, ram seal assembly, and ram body for receiving a seal that overcome deficiencies with known designs while providing better overall results.

SUMMARY OF THE PRESENT DEVELOPMENT

In accordance with one aspect of the present development, a blowout preventer ram seal includes a first section including a curved region with opposite first and second ends and a central portion that extends between and interconnects the first and second ends. A second section extends between and interconnects the first and second ends of the first section such that a seal opening is defined between the first section and second section. The second section includes a sealing region comprising a sealing region thickness. A central retention boss is connected to the sealing region and projects into the seal opening toward the first seal section. The central retention boss includes a retention boss thickness that is greater than the sealing region thickness such that the central retention boss is enlarged relative to the sealing region. First and second lateral retention bosses are respectively connected to the first and second opposite ends of the first seal section. The first and second lateral retention bosses extend outward from one side of the first seal section such that both of the first and second lateral retention bosses extend outwardly from the first seal section in the same direction and are arranged parallel and spaced-apart from each other.

In accordance with another aspect of the present development, a ram seal assembly for a blowout preventer includes a metal ram body including a cylindrical outer surface and opposite inner and outer faces. The outer face includes a ram shaft coupling structure adapted to be connected to an associated ram shaft. The ram body further includes a continuous outwardly opening seal-receiving groove that extends along the ram body. The groove comprising a first section including first and second ends located respectively on first and second lateral sides of the ram body, a second section that extends across the inner face of said ram body between the first and second ends of said first section, a third section connected to the second section, and first and second lateral boss recesses located on the opposite lateral sides of the ram body. An elastomeric ram seal is located in the seal-receiving groove. The seal includes a first seal section comprising a curved region including opposite first and second ends and a central portion that extends between and interconnects the first and second ends. A second seal section extends between and interconnects the first and second ends of the first seal section such that a seal opening is defined between the first seal section and second seal section. The second seal section includes a sealing region comprising a sealing region thickness. A central retention boss is connected to the sealing region and that projects into the seal opening toward the first seal section. The central retention boss includes a retention boss thickness that is greater than the sealing region thickness such that the central retention boss is enlarged relative to the sealing region. First and second lateral retention bosses are respectively connected to the first and second opposite ends of the first seal section. The first and second lateral retention bosses extends perpendicularly outward from one side of the first seal section such that both of the first and second lateral retention bosses extend outwardly from the first seal section in the same direction and are arranged parallel and spaced-apart from each other. The first seal section is seated in the first groove section, the second seal section is seated in the second groove section, the central retention boss is seated in the third groove section, and the first and second lateral retention bosses are respectively seated in the first and second lateral boss recesses.

DETAILED DESCRIPTION OF THE PRESENT DEVELOPMENT

Figure 1A:
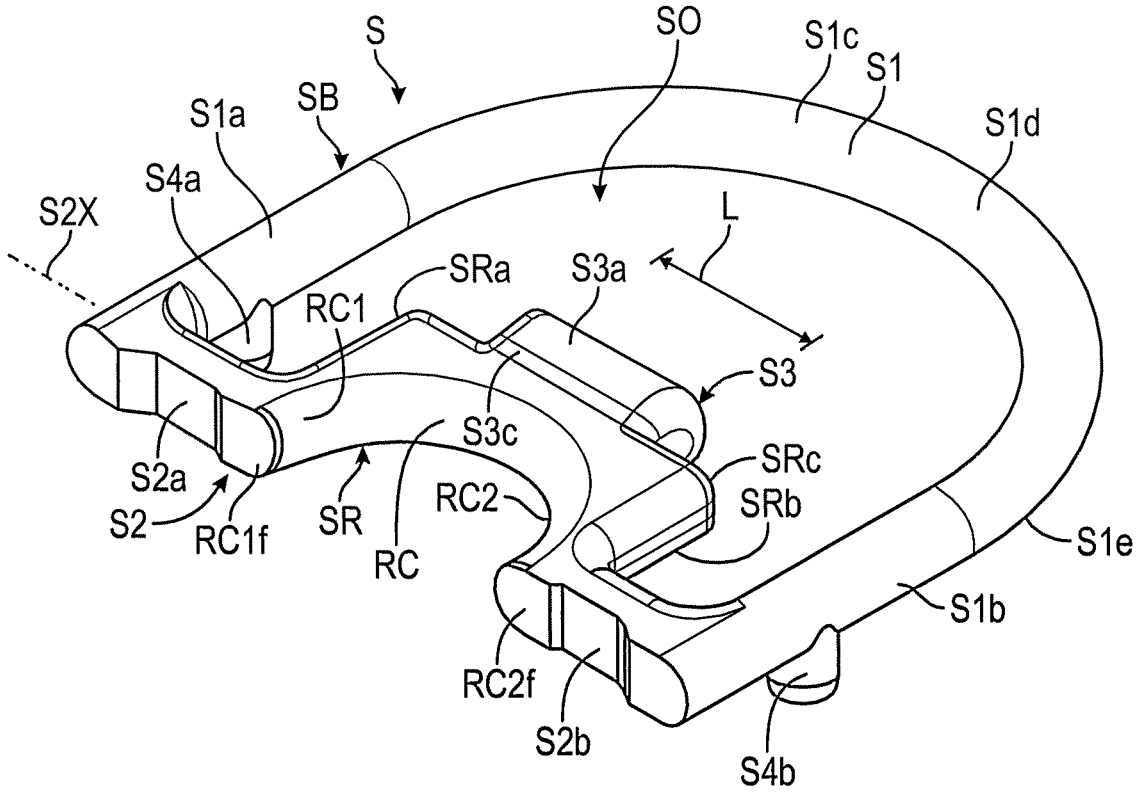
FIG. 1A is an isometric view of a blowout preventer ram seal in accordance with a first aspect of the present development.
Figure 1B:
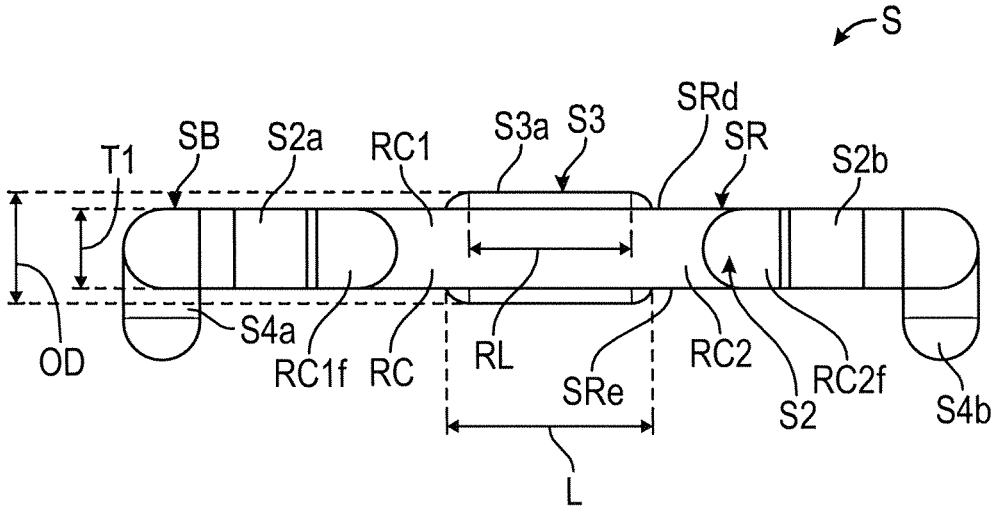
FIGS. 1B and 1C are front and right side views of the seal of FIG. 1A, respectively.
Figure 1C:
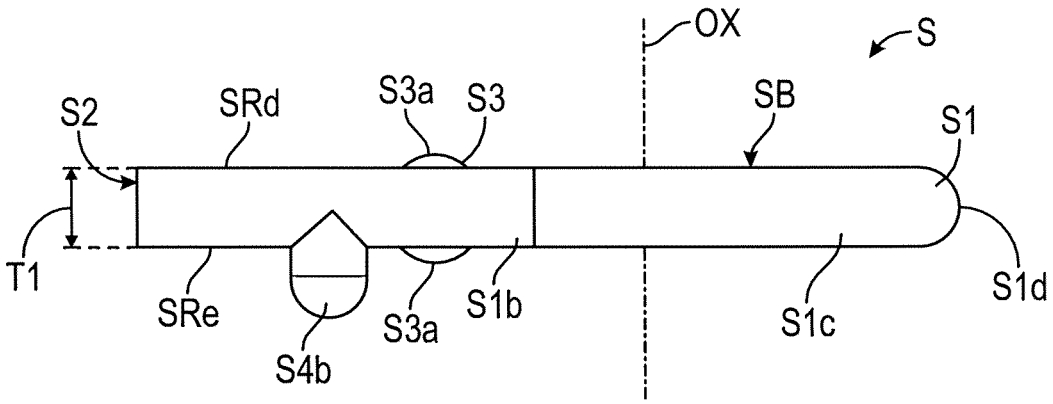

A first aspect of the present development relates to a blowout preventer (BOP) ram seal S as shown in FIGS. 1A-1C. In addition to the seal S, itself, the present development comprises a metal ram body RB (shown by itself in FIGS. 2A-2E) onto which the seal S can be operatively installed as shown in FIGS. 3A-3D to form a ram seal assembly RSA in accordance with an embodiment of the present development. The ram seal assembly RSA for the BOP is comprised of two components, the rubber seal S and the metal ram body RB.

The seal S and ram body RB can each be made from a variety of conventional materials and manufacturing techniques without departing from the scope and intent of the invention. In one embodiment, the seal S comprises a one-piece molded polymeric structure such as a one-piece elastomeric structure comprising nitrile rubber, a fluorinated, carbon-based synthetic rubber (fluoroelastomer) such as FKM, or another suitable elastomeric compound or blend thereof. In one embodiment, the seal is injection molded but it can be formed using any other suitable process. The ram body RB can be a one-piece or structure comprising a metal such as high-grade carbon steel or high-grade stainless steel or another suitable metal. Other materials and structures can be used as are generally known in the art.

Referring particularly to FIGS. 1A-1C, the seal S comprises a one-piece elastomeric seal body SB including a central seal opening SO. The seal body SB comprises four main sections or regions or portions that work in combination to minimize the amount of displacement or movement of the seal S relative to the ram body RB during use.

The one-piece elastomeric seal body SB comprises a first portion or first section S1 comprising a curved (e.g., semi-circular) central region or portion S1*c* with opposite first and second ends S1*a*, S1*b* that are arranged parallel to each other. The curved central portion S1*c* extends between and interconnects the opposite first and second ends S1*a*, S1*b*. The first section S1 comprises a mid-point S1*d* located on the curved central portion S1*c* halfway between the opposite first and second ends S1*a*, S1*b* which is the deepest point of the curved portion S1*c*. The first section S1 is shown with a circular cross-section such that it comprises a cylindrical outer surface S1*e*. The first section S1 defines a substantial part of the periphery such as at least a majority of the periphery (e.g., >50%) of the seal opening SO.

The seal body SB further comprises a second, inner section S2 that extends between and interconnects the opposite first and second ends S1*a*, S1*b* of the first section S1 to complete the periphery of the seal opening SO such that the first and second sections S1,S2 cooperate to define the seal opening SO and its periphery, i.e., the periphery of the seal opening SO is defined by the first and second seal sections S1,S2. The second section S2 lies in the same plane as the first section S1 and comprises opposite first and second ends S2*a*, S2*b* that are connected respectively to the first and second ends S1*a*, S1*b* of the first section S1. The first and second ends S2*a*, S2*b* of the second section S2 are coaxially aligned along a second section axis S2X that extends between the opposite first and second ends S1*a*, S1*b* of the first section S1.

Between its opposite first and second ends S2*a*, S2*b*, the second section S2 defines an enlarged seal region or sealing region SR that, in the illustrated embodiment, comprises a semi-circular seal recess RC with a circular radiused inside surface that is adapted and configured to sealingly engage the outer cylindrical surface of an associated polished rod or other cylindrical rod or member of an associated oil or gas well. In the illustrated embodiment, the seal recess RC is semi-circular and extends through an arc of or comprising 180 degrees as it extends between and interconnects the opposite first and second ends S2*a*, S2*b* of the second section S2. The arcuate seal recess RC is terminated at it opposite first and second ends RC1, RC2 by first and second seal (or sealing) faces RC1*f*, RC2*f* that can be planar as shown or otherwise conformed and adapted to mate in a fluid tight manner with corresponding seal faces RC2*f*, RC1*f* of a second identical seal S of an adjacent second ram seal assembly RSA of a pair of ram seal assemblies RSA such as the first and second ram seal assemblies RSA1, RSA2 as described in further detail below and shown in FIG. 7. In the illustrated embodiment, the seal region SR in which the seal recess RC is located comprises first and second parallel, spaced-apart side walls SRa, SRb and an end wall SRc that extends between and interconnects the first and second side walls SRa, SRb. As shown in FIG. 1B, the sealing region SR further comprises opposite parallel upper and lower faces SRd, SRe and a maximum thickness T1 of the sealing region SR (i.e., a sealing region thickness T1) is defined between the upper and lower faces SRd, SRe.

The seal body SB further comprises a bulbous central retention boss S3 that is connected to and that projects from the end wall SRc of the seal region SR of the second section S2 opposite the seal recess RC outwardly or rearwardly into the seal opening SO away from the seal recess RC toward the mid-point S1*d* of the first seal section S1. The central retention boss S3 is aligned with the seal recess RC but on the opposite side of the second section S2 as compared to the seal recess RC. In the illustrated embodiment, the retention boss S3 comprises a partially cylindrical cross-section and partially cylindrical outer surface S3*a* (where "partially cylindrical" means a radiused cross-section or radiused outer surface that extends for less than 360 degrees about its center), and the central retention boss S3 is bulbous or enlarged relative to the adjacent connecting part or neck S3C of the second section S2 by which the retention boss S3 is attached to the second section S2. As shown, the central retention boss S3 comprises a maximum thickness or outside diameter OD (FIG. 1B) that is greater than the maximum thickness T1 of the sealing region SR when both are measured along an axis parallel to the central axis OX of the seal opening SO such that the central retention boss S3 is bulbously enlarged relative to the seal region SR of the second section S2. The retention boss S3 extends axially toward and away from the first and second opposite ends S1*a*, S1*b* of the seal first section S1 along an axis that is parallel to the second axis S2*x* and defines a partially cylindrical body that is centrally and symmetrically located relative to the seal recess RC such that a center of the retention boss S3 is aligned with the midpoint Std (the deepest point) of the seal recess RC and such that the retention boss S3 extends laterally outward from its center in opposite first and second directions respectively toward the first and second ends S1*a*, S1*b* of the first seal section. The central retention boss S3 thus defines an axial length L (FIG. 1A) along which its outer partially cylindrical surface S3*a* extends. Furthermore, the retention boss S3 is connected to the seal region SR by the connecting portion or neck S3C of the second section S2 that preferably also extends coextensively with the retention boss S3 for at least the axial length L. Those of ordinary skill in the art will recognize that the axially length L of the central retention boss S3 and its connecting region S3C overlaps or coincides with an axial length RL (FIG. 1*b*) of the deepest or innermost region of the seal recess RC such that the central retention boss S3 effectively retains and minimizes movement or extrusion of the seal recess RC in its operative position during use.

The seal body SB further comprises first and second lateral retention bosses S4*a*, S4*b* that are respectively connected to the first and second opposite ends S1*a*, S1*b* of the first seal section S1. These lateral retention bosses S4*a*, S4*b* extend perpendicularly outward from one side of the first seal section S1 in the same direction with respect to each other such that the lateral retention bosses S4*a*, S4*b* are arranged parallel and spaced-apart relative to each other. The first and second lateral retention bosses S4*a*, S4*b* are thus arranged to extend perpendicularly outward from the plane in which the first and second seal sections S1,S2 and the seal retention boss S3 are located.

The metal ram body RB is dimensioned and conformed for operative securement of the seal S thereto to define the ram seal assembly RSA. The seal S is removable from the ram body RB by manual operation for installation and repair or replacement, but the seal S is designed to resist movement or "extrusion" during use so that it remains connected to the ram body RB in its operative position as shown in FIGS. 3A-3D.

Shown by itself in FIGS. 2A-2E, the ram body RB is generally cylindrical in shape and comprises a cylindrical outer surface RB1. The ram body RB comprises opposite inner and outer faces F1, F2 that can be planar and parallel with respect to each other. The inner face F1 comprises a semi-circular or semi-cylindrical body recess BR centered on a longitudinal axis LX (FIG. 7) to closely receive the outer cylindrical surface of a polished rod or other cylindrical member PR. The outer face F2 includes a ram shaft coupling structure F2C that is adapted to be connected to a ram shaft (not shown) that moves the ram body RB.

A continuous outwardly opening seal-receiving groove G extends along the ram body RB and is adapted and configured for operative installation and securement of the seal S. The groove G comprises a first section G1 adapted to receive and retain the first section S1 of the seal. The first groove section G1 extends from a first end G1*a* located on a first lateral side of the ram body RB across the ram body outer surface RB1 to a second end G1*b* located on a second lateral side of the ram body RB.

The groove G further comprises a second section G2 adapted to receive and retain the second section S2 of the seal S. The second section G2 of the groove extends across the inner face F1 and includes opposite first and second ends G2*a*, G2*b* that connect respectively to the first and second ends G1*a*, G1*b* of the first groove section G1. The second groove section G2 includes a portion Glc that extends through the semi-cylindrical body recess BR to receive the sealing region SR of seal S so that the seal recess RC is aligned with the body recess BR and positioned to engage the cylindrical outer surface of a polished rod or other cylindrical member located in the body recess BR as shown in FIG. 7.

Figure 2A:
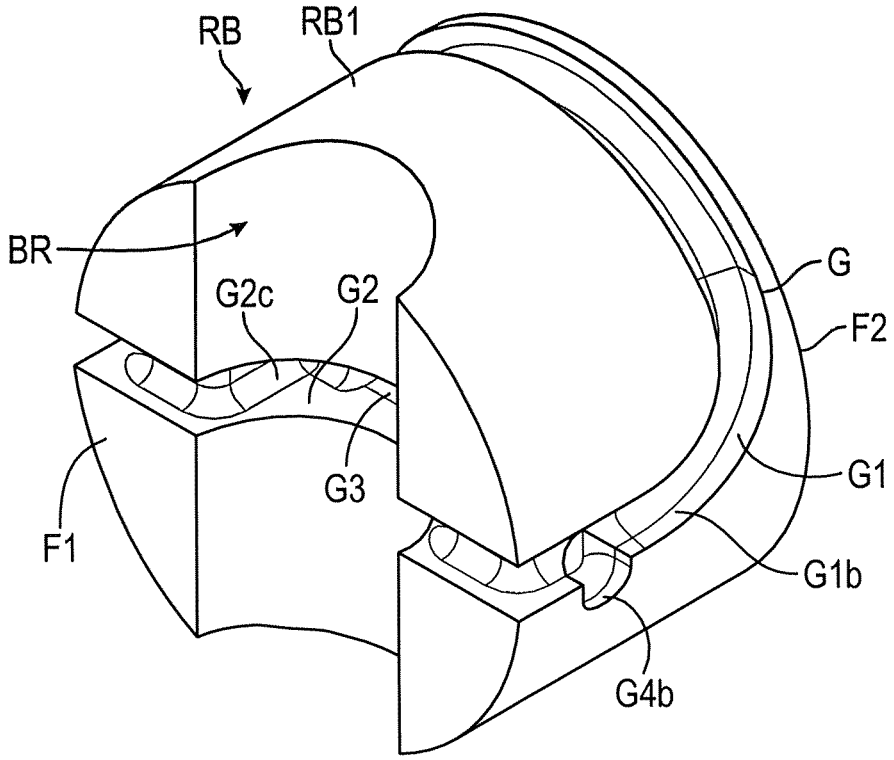
FIG. 2A is an isometric view of a blowout preventer ram body in accordance with one aspect of the present development and adapted for operative installation of the seal of FIGS. 1A-1C.
Figure 2B:
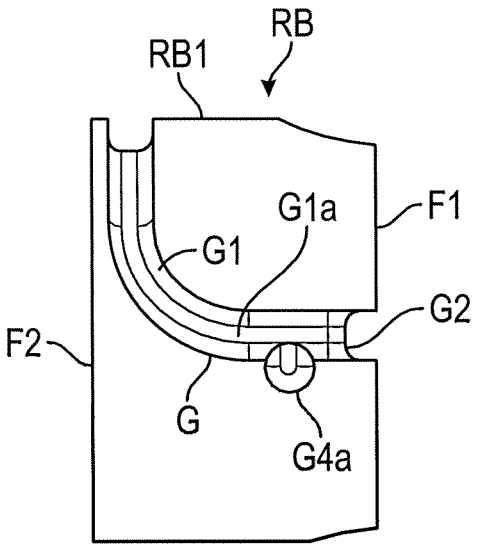
FIGS. 2B and 2C are respective left side and front views of the ram body of FIG. 2A.
Figure 2C:
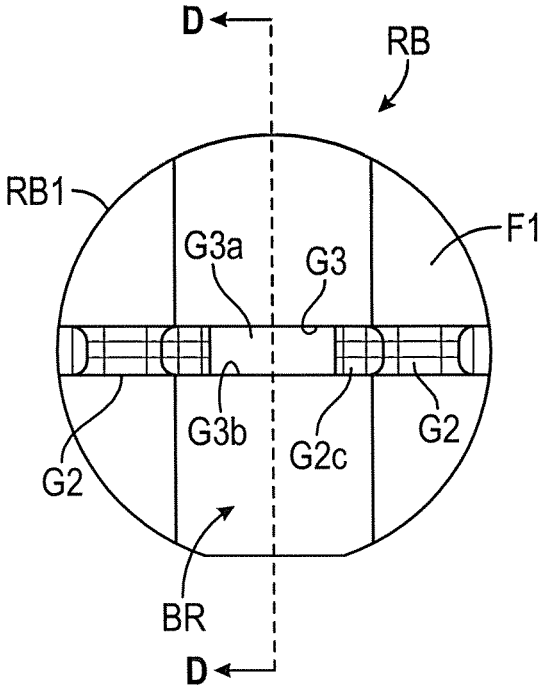
Figure 2D:
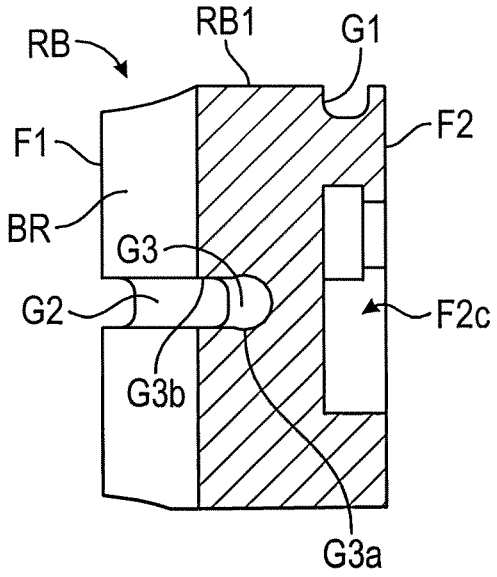
FIG. 2D is a section view taken at D-D of FIG. 2C.
Figure 2E:
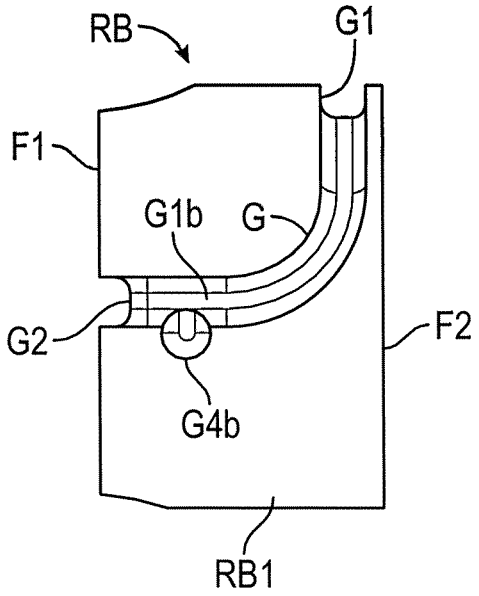
FIG. 2E is a right side view of the ram body of FIG. 2A.

The groove G further comprises a third, central boss receiving section G3 connected to the second section G2 that is adapted to receive and retain the retention boss S3 of the seal S. As best seen in FIG. 2D and also FIG. 3C, the third section G3 of the groove G comprises an inner portion or inner region G3*a* with a partially cylindrical cross section that is dimensioned and conformed to closely receive and retain the seal central retention boss S3 with a close, resilient snap fit such that the central retention boss S3 is resiliently captured in the inner region G3*a* of the third groove section G3. An outer portion or outer region G3*b* of the third groove section G3 is reduced in height as compared to the inner semi-cylindrical section G3*a* so that the retention boss S3 must be compressed and forced therethrough into the inner section G3*a* to achieve the noted snap-fit engagement of the retention boss S3 in the inner section G3*a*. The outer portion G3*b* closely accommodates the thickness T1 of the seal region SR. The neck S3*c* of the seal S that connects the retention boss S3 to the end wall SRc is located in the outer portion G3*b* of the third groove section G3. The outer portion G3*b* of the third groove section G3 is connected to the second groove section G2, and the third groove section G3 is preferably located midway between the opposite first and second ends G2*a*, G2*b* of the second groove section G2.

Figure 3A:
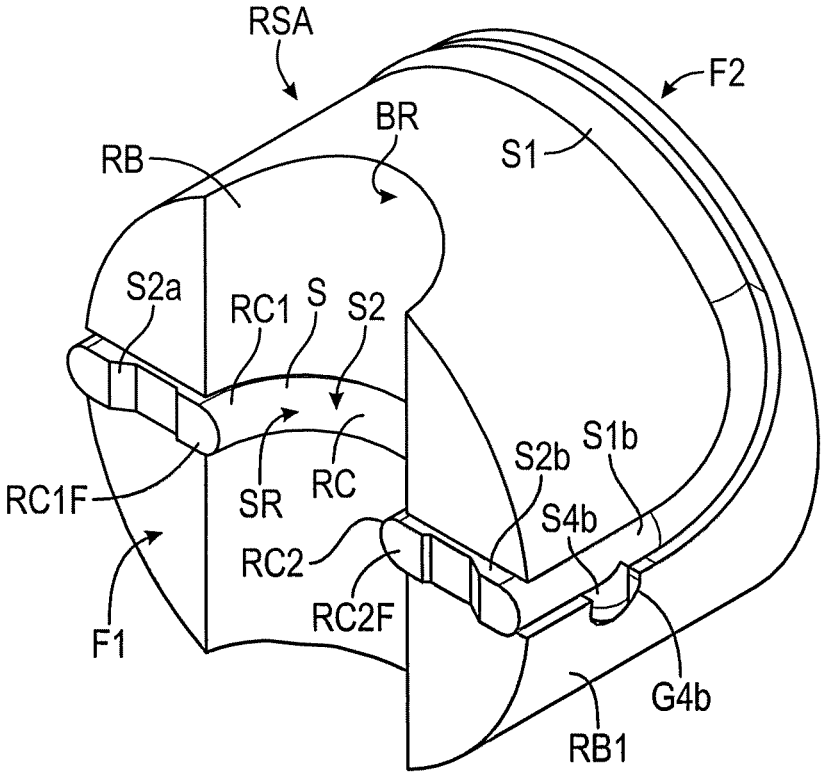
FIG. 3A is an isometric view of an embodiment of a ram seal assembly in accordance with one aspect of the present development comprising the seal of FIG. 1A operatively installed on the ram body of FIG. 2A.
Figure 3B:
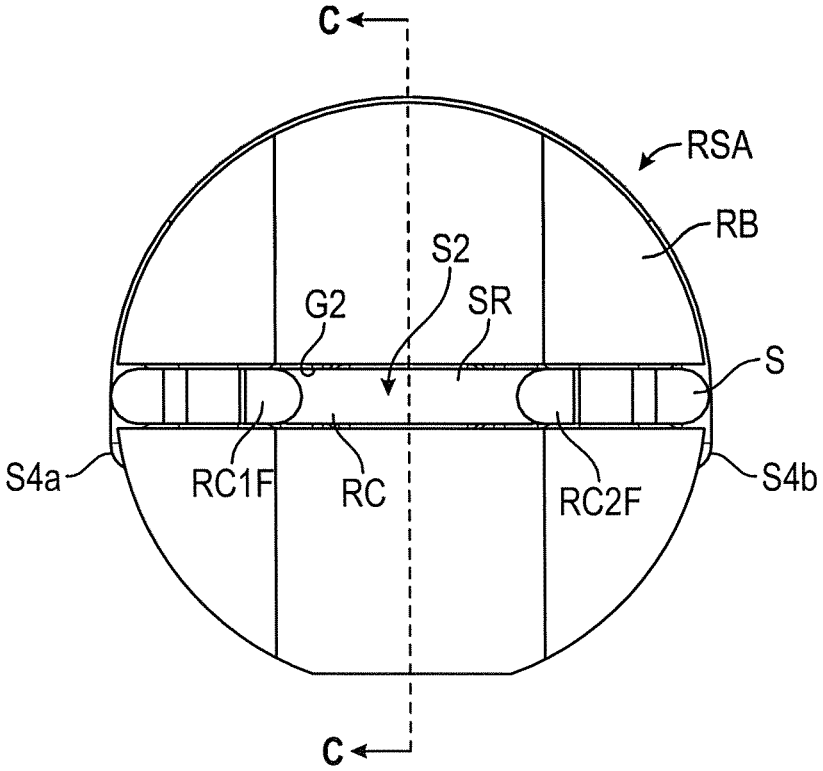
FIG. 3B is a front view of the ram seal assembly of FIG. 3A.
Figure 3C:
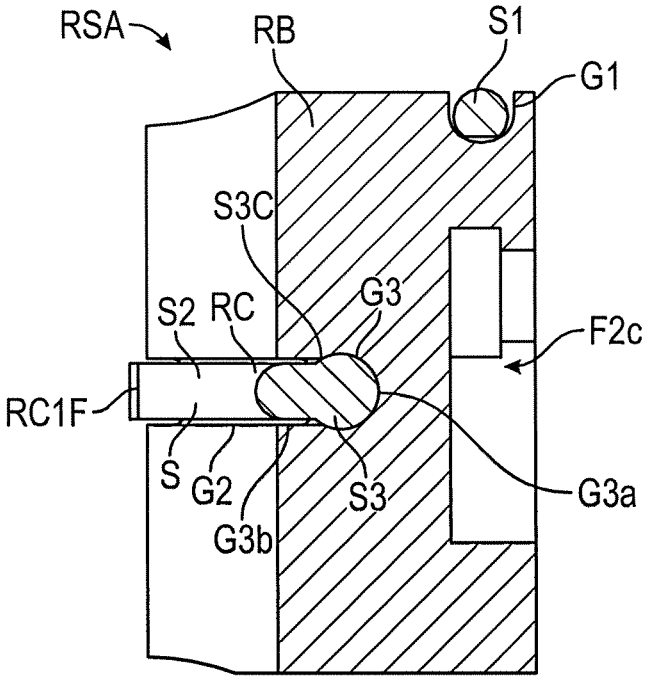
FIG. 3C is a section view taken at C-C of FIG. 3B.
Figure 3D:
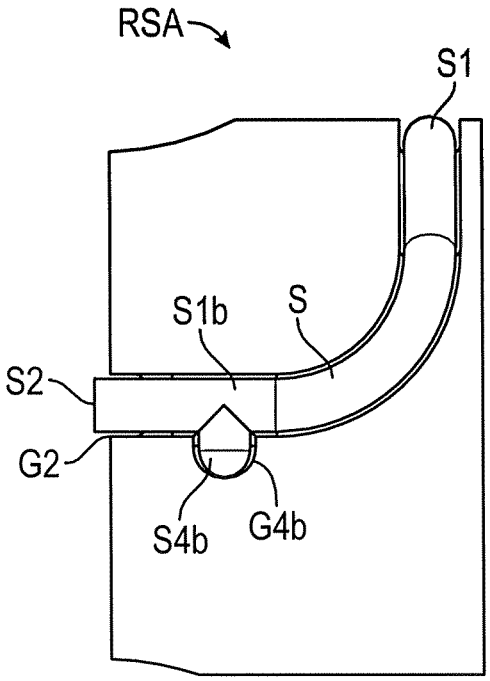
FIG. 3D is a right side view of the ram seal assembly of FIG. 3A.
Figure 4A:
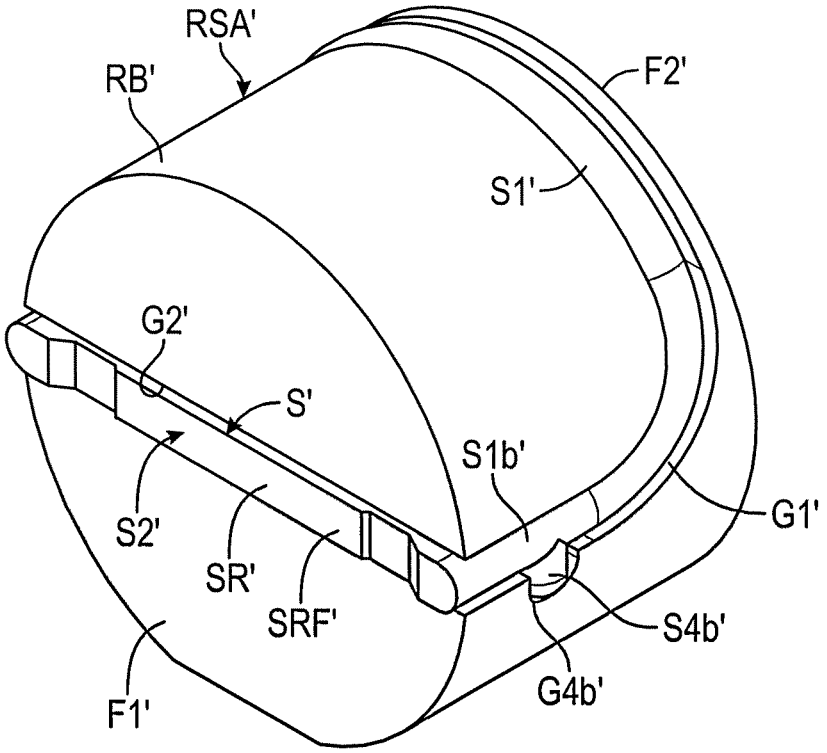
FIGS. 4A-4D respectively correspond to FIGS. 3A-3D but show a blind ram seal assembly provided in accordance with an alternative embodiment if the present development.
Figure 4B:
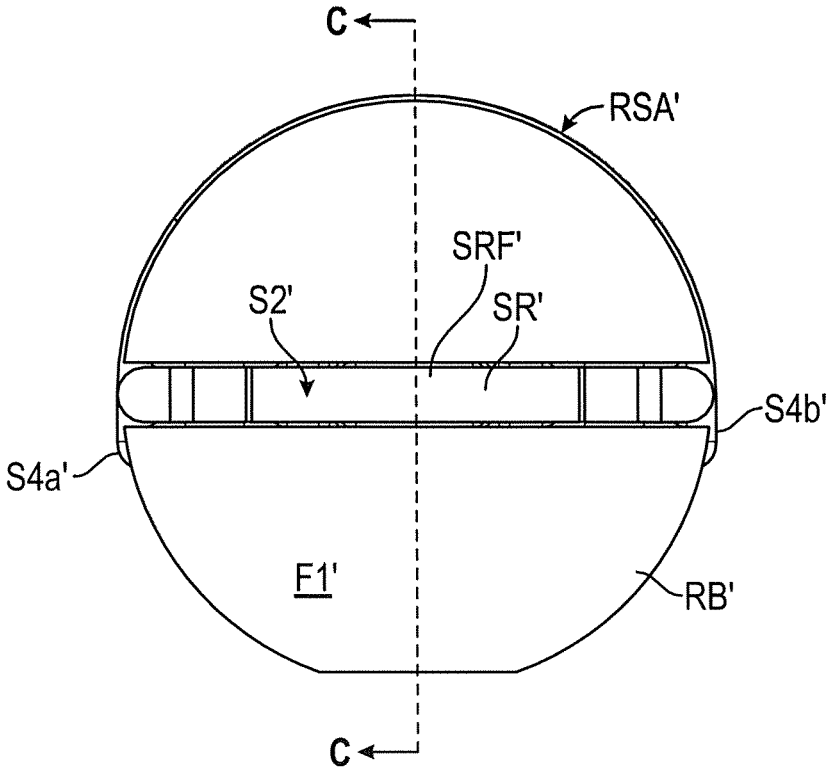
Figure 4C:
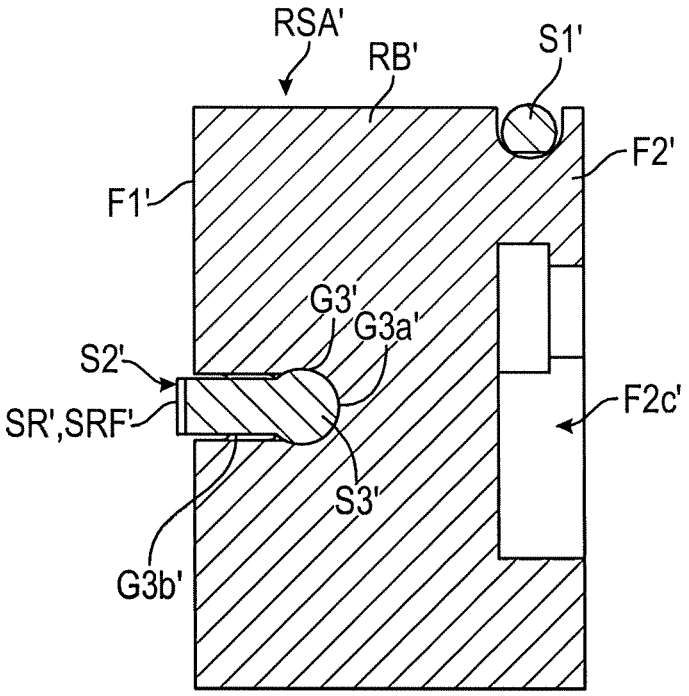
Figure 4D:
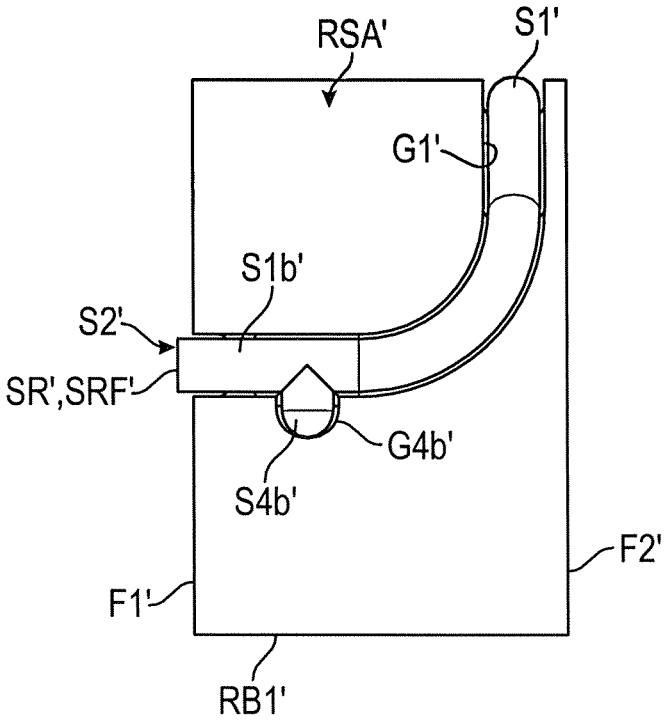

The groove G further comprises first (left) and second (right) lateral boss recesses G4*a* and G4*b* that are located on opposite lateral sides of the ram body RB. The first lateral boss recess G4*a* is located at the intersection of the first end G1*a* of the first groove section G1 and the first end G2*a* of the second groove section G2. Likewise, the second lateral boss recess G4*a* is located at the intersection of the second end G1*b* of the first groove section G1 and the second end G2*b* of the second groove section G2. The first and second lateral boss recesses G4*a*, G4*b* are adapted to closely receive and retain the lateral retention bosses S4*a*, S4*b* of the seal S, respectively, as shown in FIGS. 3A & 3D.

Figure 7:
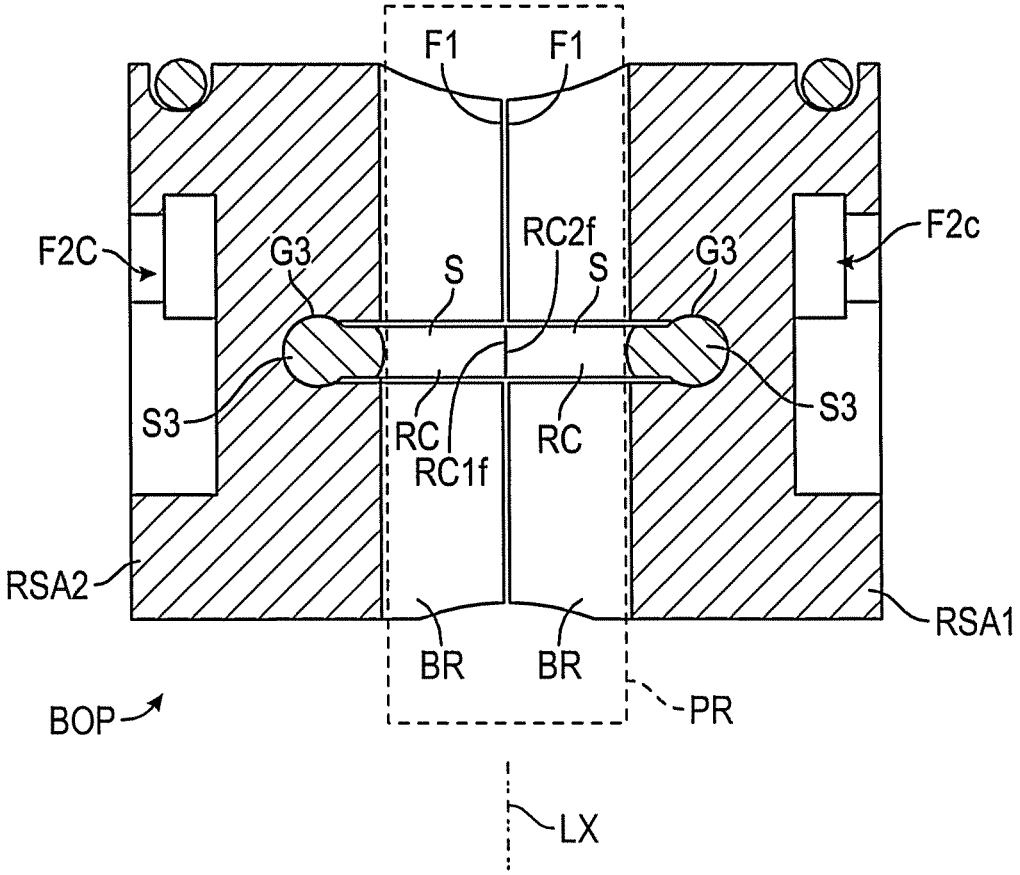
FIG. 7 illustrates a pair of ram seal assemblies of the embodiment shown in FIG. 3A operatively arranged relative to each other and operatively engaged with an associated polished rod or other cylindrical member to provide an annular seal about the cylindrical member.

As shown in FIG. 7, those of ordinary skill in the art will recognize that a blowout preventer BOP will comprises a pair of like ram seal assemblies RSA (RSA1,RSA2) as shown herein that are adapted to cooperate with each other to sealingly engage the entire cylindrical outer surface of polished rod PR or other cylindrical member of an associated oil or gas well installation when the pair of ram seal assemblies RSA1,RSA2 are moved toward each other so that the respective seals S thereof sealingly engage the cylindrical outer surface polished rod PR. In such case, the respective seal recesses RC closely surround and seal against the outer cylindrical surface of the polished rod PR and the seal faces RC1*f*, RC2*f* of one seal S engage the opposite corresponding seal faces RC2*f*, RC1*f* of the other seal S to define a 360-degree sealing interface around the polished rod PR.

Figure 5A:
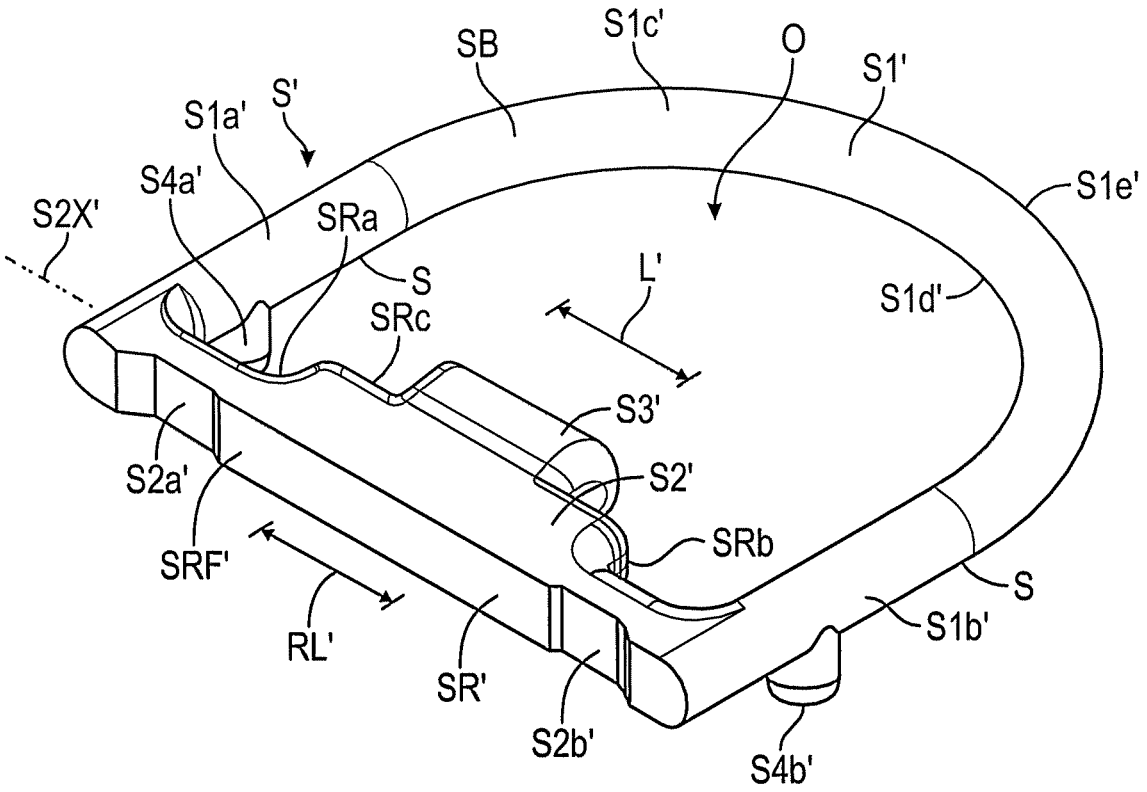
FIGS. 5A-5C are respective isometric, front, and right side views of an alternative embodiment of a blowout preventer seal for use as part of the ram seal assembly of FIGS. 4A-4D.
Figure 5B:
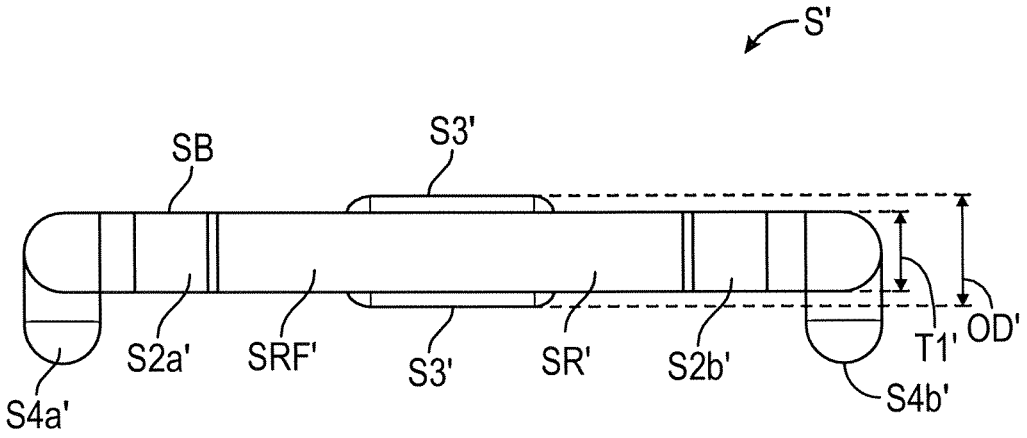
Figure 5C:
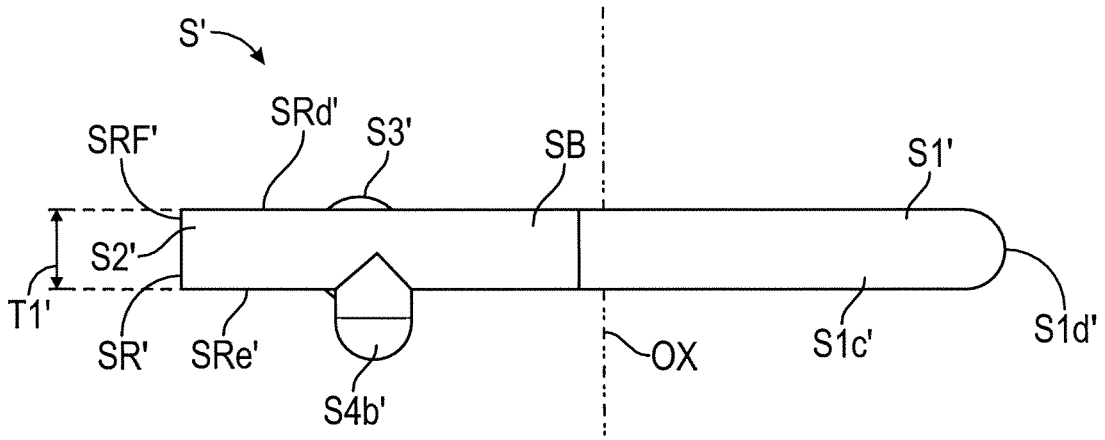
Figure 6A:
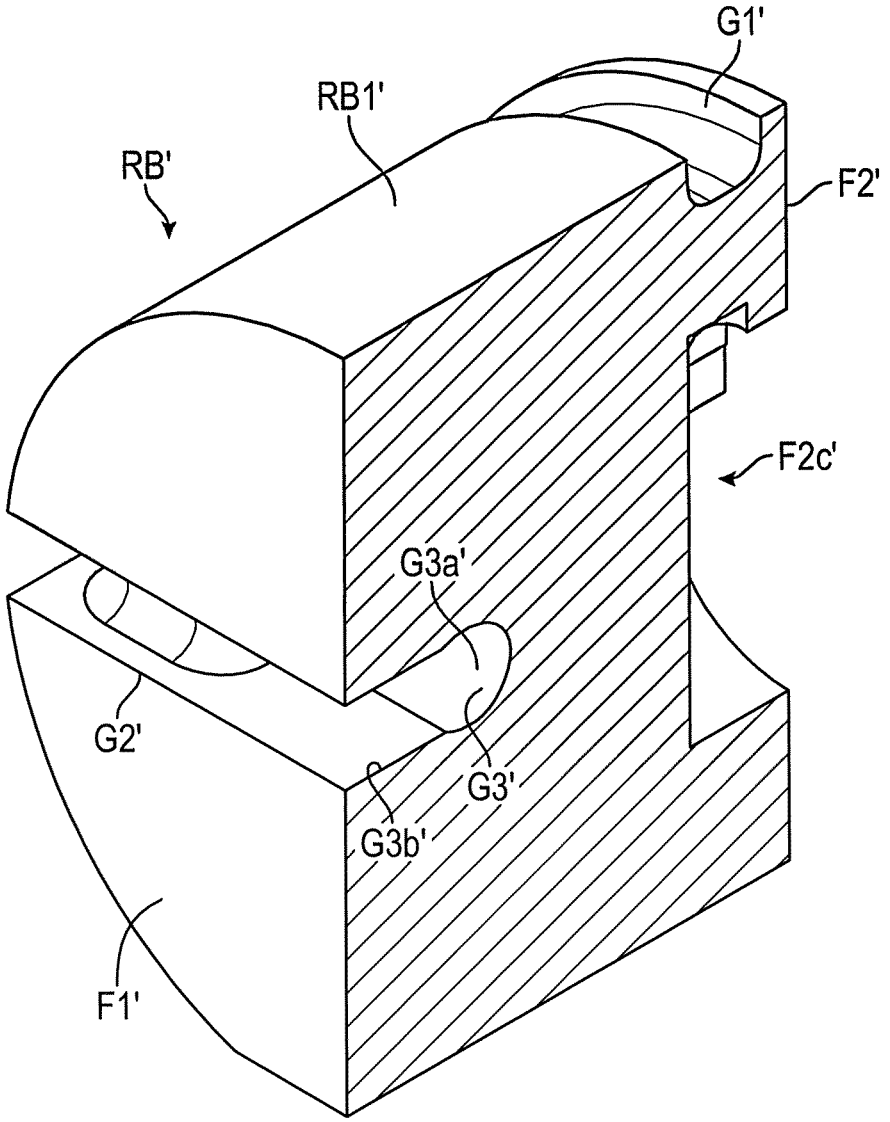
FIGS. 6A-6E correspond respectively with FIGS. 2A-2E but show the ram body of the embodiment of FIGS. 4A-4D.
Figure 6B:
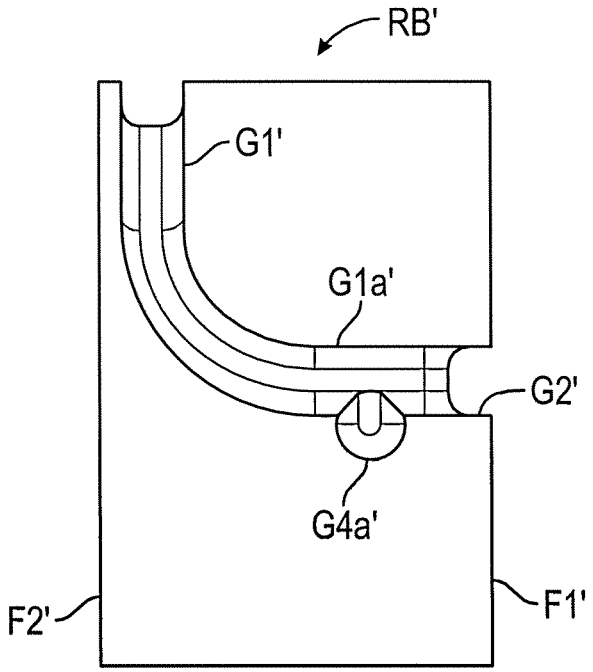
Figure 6C:
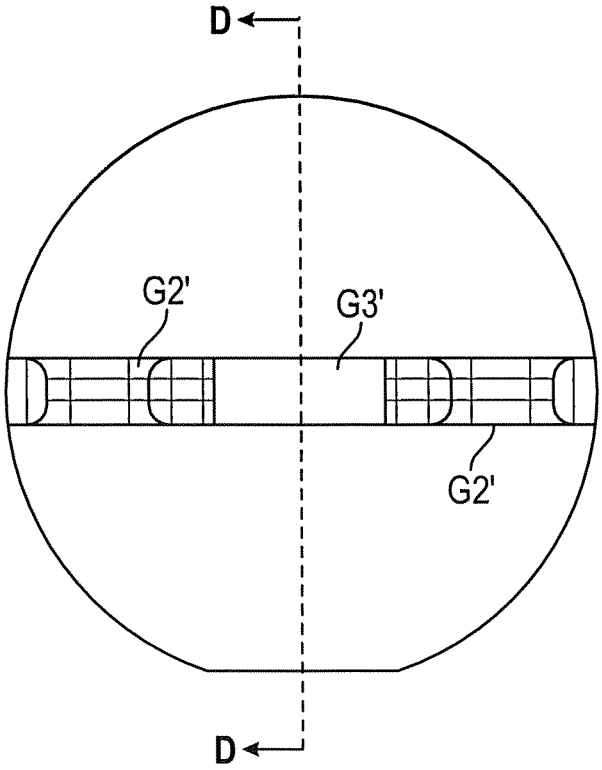
Figure 6D:
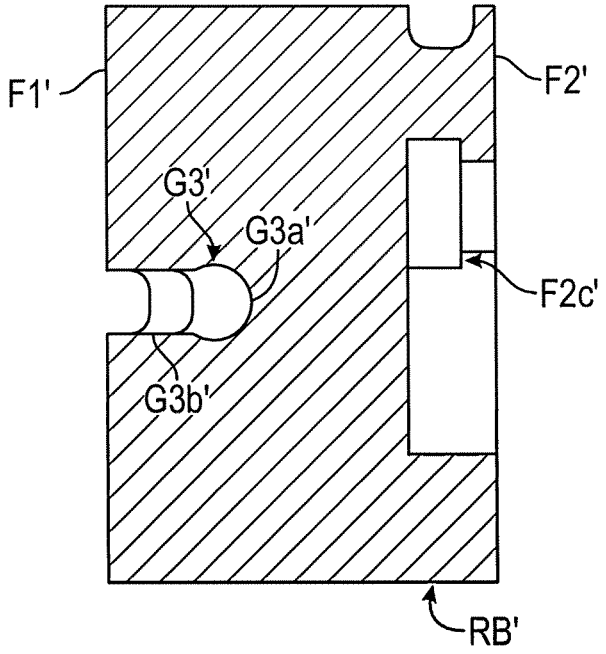
Figure 6E:
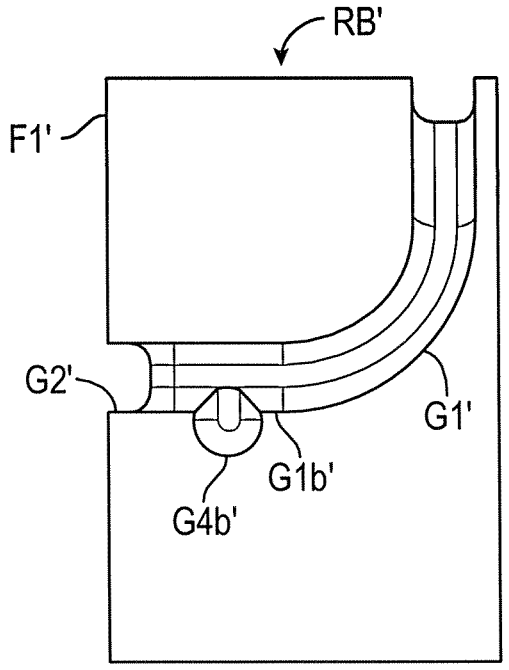
Figure 8:
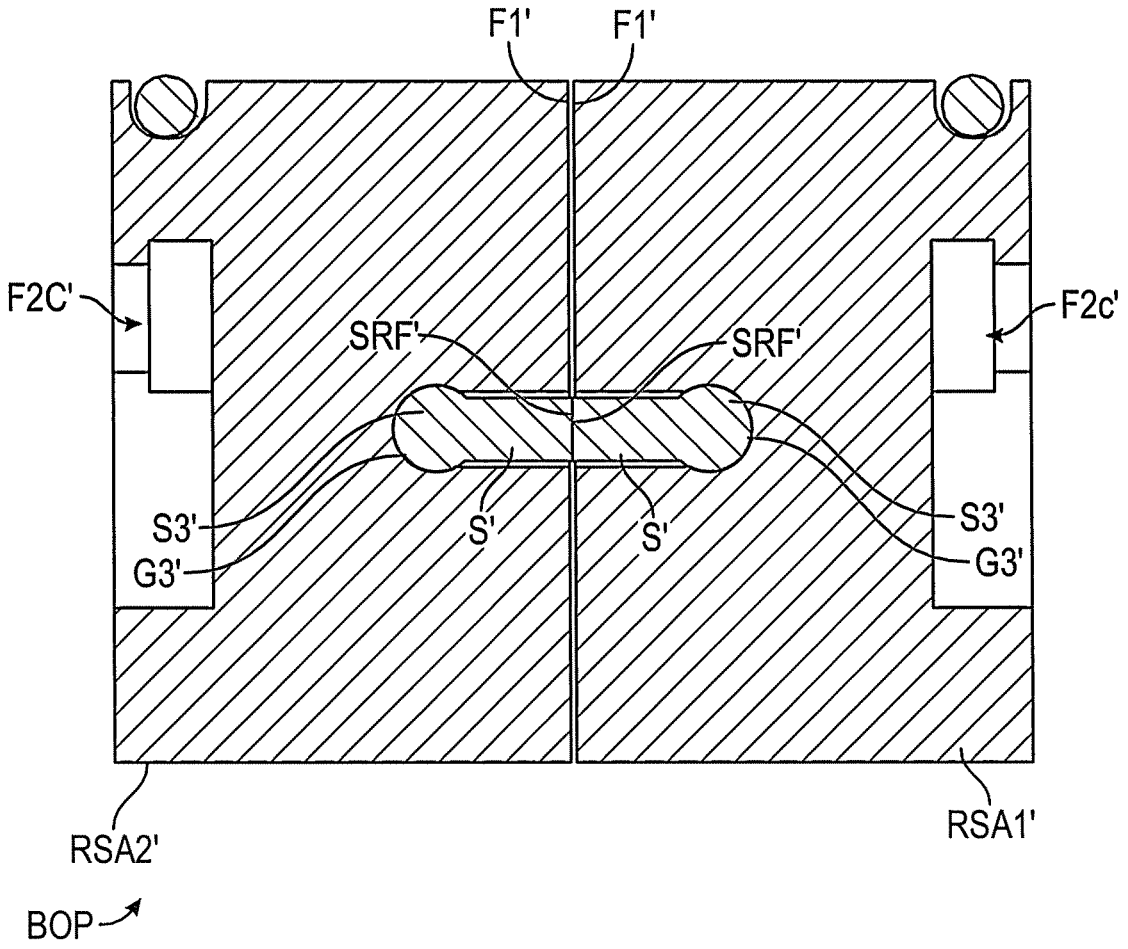
FIG. 8 is similar to FIG. 7 but shows a pair of blind ram seal assemblies of the embodiment shown in FIG. 4A operatively arranged relative to each other and operatively and sealingly engaged with each other to define a blowout preventer seal.

In an alternative embodiment, the ram seal assemblies RSA are configured as blind ram seal assemblies as shown at RSA' in FIG. 4A-4D, which correspond respectively to FIGS. 3A-3D. In such case, the blind ram seal assemblies RSA' are adapted to sealingly engage each other when no polished rod or other cylindrical pipe or rod is present as shown in FIG. 8 and described below. The ram seal assembly RSA' comprises a blind ram seal S' shown by itself in FIGS. 5A-5C which correspond respectively to FIGS. 1A-1C. The ram seal assembly RSA' also comprises a blind ram body RB' shown by itself in FIGS. 6A-6E which correspond respectively to FIGS. 2A-2E (except that FIG. 6A is a section view). Like components of the ram seal assembly RSA' relative to the ram seal assembly RSA are shown with like reference characters that include a primed (') designation. Similarly, like components of the seal S' relative to the seal S are shown with like reference characters that include a primed (') designation. Like components of the ram body RB' relative to the ram body RB are shown with like reference characters that include a primed (') designation.

Unlike the seal S, the second section S2' of the blind ram seal S' comprises a straight sealing region SR' that comprises a flat seal face SRF' in the illustrated embodiment. The seal face SRF' can alternatively comprise curved or angled regions instead of a planar or flat face. The central, semi-cylindrical central retention boss S3' of the seal S' is aligned with and extends for a length L' along the straight sealing region SR' on the rear side, opposite the flat seal face SFR' such that the central retention boss S3' overlaps or is axially coextensive with the straight sealing region SR' for a length RL'. Correspondingly, the inner face F1' of the ram body RB' is flat and omits the recess BR of the ram body RB. The second groove section G2' of the ram body RB' extends straight across the inner face F1'.

As shown in FIG. 8, when first and second ram seal assemblies RSA' (RSA1', RSA2') are abutted to obtain a blind seal, the respective straight sealing regions SR' (and the flat or otherwise correspondingly shaped seal faces SRF' thereof) are mated and sealingly engaged to provide the required seal.

Accordingly, those of ordinary skill in the art will recognize that a ram seal S, S' provided in accordance with the present development can comprise at least one seal face such as the seal face SRF' of the seal S', or the first and second seal faces RC1*f*, RC2*f* of the seal S.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

The invention claimed is:

1. A blowout preventer ram seal comprising:

a first seal section comprising a curved region including opposite first and second ends and a central portion that extends between and interconnects the first and second ends;

a second seal section that extends between and interconnects the first and second ends of the first seal section such that a seal opening is defined between the first seal section and second seal section, said second seal section comprising a sealing region comprising a sealing region thickness;

a central retention boss that is connected to the sealing region and that projects into the seal opening toward the first seal section, said central retention boss comprising a retention boss thickness that is greater than the sealing region thickness such that said central retention boss is enlarged relative to said sealing region;

first and second lateral retention bosses that are respectively connected to the first and second opposite ends of the first seal section, said first and second lateral retention bosses extending outward from one side of the first seal section such that both of the first and second lateral retention bosses extend outwardly from the first seal section in the same direction and are arranged parallel and spaced-apart from each other;

wherein said central retention boss extends axially toward and away from the first and second opposite ends of the seal first seal section and defines a body comprising a partially cylindrical outer surface, said body centrally and symmetrically located relative to the seal recess such that a center of the body of the central retention boss is aligned with a midpoint of the seal recess and such that the partially cylindrical outer surface of the body extends laterally outward from the center of the body in opposite first and second directions respectively toward the first and second ends of the first seal section such that said body defines an axial length along which its outer partially cylindrical outer surface extends.

2. The blowout preventer ram seal as set forth in claim 1, wherein said sealing region of said second seal section comprises at least one seal face adapted to engage a corresponding seal face of an associated second blowout preventer ram seal.

3. The blowout preventer ram seal as set forth in claim 2, wherein said at least one seal face comprises first and second seal faces and wherein said sealing region of said second seal section comprises a seal recess located between the first and second seal faces.

4. The blowout preventer ram seal as set forth in claim 3, wherein said seal recess extends through 180 degrees and said seal recess includes opposite first and second ends that are respectively terminated by said first and second seal faces.

5. The blowout preventer ram seal as set forth in claim 1, wherein said first and second ends of said first seal section are arranged parallel and spaced-apart relative to each other and wherein said first seal section comprises a circular cross-section.

6. The blowout preventer ram seal as set forth in claim 5, wherein said central retention boss is connected to the seal region by a neck of said second seal section.

7. A blowout preventer ram seal comprising:

a first seal section comprising a curved region including opposite first and second ends and a central portion that extends between and interconnects the first and second ends;

a second seal section that extends between and interconnects the first and second ends of the first seal section such that a seal opening is defined between the first seal section and second seal section, said second seal section comprising a sealing region comprising a sealing region thickness;

a central retention boss that is connected to the sealing region and that projects into the seal opening toward the first seal section, said central retention boss comprising a retention boss thickness that is greater than the sealing region thickness such that said central retention boss is enlarged relative to said sealing region;

first and second lateral retention bosses that are respectively connected to the first and second opposite ends of the first seal section, said first and second lateral retention bosses extending outward from one side of the first seal section such that both of the first and second lateral retention bosses extend outwardly from the first seal section in the same direction and are arranged parallel and spaced-apart from each other;

wherein said sealing region of said second seal section comprises:

opposite upper and lower faces between which the sealing region thickness is defined;

first and second parallel spaced apart side walls; and, an end wall that extends between and interconnects the first and second side walls;

wherein said central retention boss is connected to said end wall by a neck and projects outwardly from said end wall into said seal opening.

8. The blowout preventer ram seal as set forth in claim 7, wherein said first seal section, said second seal section, said central retention boss, and said first and second lateral retention bosses are defined as part of a one-piece molded elastomeric structure.

9. A ram seal assembly for a blowout preventer, said ram seal assembly comprising:

a metal ram body comprising a cylindrical outer surface and opposite inner and outer faces, said outer face including a ram shaft coupling structure adapted to be connected to an associated ram shaft, said ram body further comprising a continuous outwardly opening seal-receiving groove that extends along the ram body, said groove comprising a first section including first and second ends located respectively on first and second lateral sides of said ram body, a second section that extends across said inner face of said ram body between said first and second ends of said first section, a third section connected to the second section, and first and second lateral boss recesses located on the opposite lateral sides of the ram body;

an elastomeric ram seal located in said seal-receiving groove, said seal comprising:

a first seal section comprising a curved region including opposite first and second ends and a central portion that extends between and interconnects the first and second ends;

a second seal section that extends between and interconnects the first and second ends of the first seal section such that a seal opening is defined between the first seal section and second seal section, said second seal section comprising a sealing region comprising a sealing region thickness;

a central retention boss that is connected to the sealing region and that projects into the seal opening toward the first seal section, said central retention boss comprising a retention boss thickness that is greater than the sealing region thickness such that said central retention boss is enlarged relative to said sealing region;

first and second lateral retention bosses that are respectively connected to the first and second opposite ends of the first seal section, said first and second lateral retention bosses extending outward from one side of the first seal section such that both of the first and second lateral retention bosses extend outwardly from the first seal section in the same direction and are arranged parallel and spaced-apart from each other;

wherein said first seal section is seated in said first groove section, said second seal section is seated in said second groove section, said central retention boss is seated in said third groove section, and said first and second lateral retention bosses are respectively seated in said first and second lateral boss recesses;

wherein said central retention boss of said seal extends axially toward and away from the first and second opposite ends of the seal first section and defines a body comprising a partially cylindrical outer surface, said body centrally and symmetrically located relative to the seal recess such that a center of the body is aligned with a midpoint of the seal recess and such that the partially cylindrical outer surface of the body extends laterally outward from the center of the body in opposite first and second directions respectively toward the first and second ends of the first seal section such that said body defines an axial length along which its outer partially cylindrical outer surface extends.

10. The ram seal assembly as set forth in claim 9, wherein said sealing region of said second seal section comprises at least one seal face adapted to engage a corresponding seal face of an associated second ram seal assembly.

11. The ram seal assembly as set forth in claim 10, wherein said at least one seal face comprises first and second seal faces and wherein said sealing region of said second seal section comprises a seal recess located between the first and second seal faces.

12. The ram seal assembly as set forth in claim 11, wherein said seal recess extends through 180 degrees and said seal recess includes opposite first and second ends that are respectively terminated by said first and second seal faces.

13. The ram seal assembly as set forth in claim 12, wherein said inner face of said ram body comprises a semi-cylindrical body recess to closely receive the outer cylindrical surface of an associated cylindrical member and wherein said seal recess is aligned with said body recess.

14. The ram seal assembly as set forth in claim 9, wherein said first and second ends of said first seal section are arranged parallel and spaced-apart relative to each other and wherein said first section comprises a circular cross-section.

15. The ram seal assembly as set forth in claim 14, wherein:

said central retention boss is connected to the seal region by a neck of said second section; and, said central retention boss is located an inner region of said third groove section.

16. A ram seal assembly for a blowout preventer, said ram seal assembly comprising:

a metal ram body comprising a cylindrical outer surface and opposite inner and outer faces, said outer face including a ram shaft coupling structure adapted to be connected to an associated ram shaft, said ram body further comprising a continuous outwardly opening seal-receiving groove that extends along the ram body, said groove comprising a first section including first and second ends located respectively on first and second lateral sides of said ram body, a second section that extends across said inner face of said ram body between said first and second ends of said first section, a third section connected to the second section, and first and second lateral boss recesses located on the opposite lateral sides of the ram body;

an elastomeric ram seal located in said seal-receiving groove, said seal comprising:

a first seal section comprising a curved region including opposite first and second ends and a central portion that extends between and interconnects the first and second ends;

a second seal section that extends between and interconnects the first and second ends of the first seal section such that a seal opening is defined between the first seal section and second seal section, said second seal section comprising a sealing region comprising a sealing region thickness;

a central retention boss that is connected to the sealing region and that projects into the seal opening toward the first seal section, said central retention boss comprising a retention boss thickness that is greater than the sealing region thickness such that said central retention boss is enlarged relative to said sealing region;

first and second lateral retention bosses that are respectively connected to the first and second opposite ends of the first seal section, said first and second lateral retention bosses extending outward from one side of the first seal section such that both of the first and second lateral retention bosses extend outwardly from the first seal section in the same direction and are arranged parallel and spaced-apart from each other;

wherein said first seal section is seated in said first groove section, said second seal section is seated in said second groove section, said central retention boss is seated in said third groove section, and said first and second lateral retention bosses are respectively seated in said first and second lateral boss recesses;

wherein said sealing region of said second seal section comprises:

opposite upper and lower faces between which the sealing region thickness is defined; and, first and second parallel spaced apart side walls;

an end wall that extends between and interconnects the first and second side walls;

wherein said central retention boss is connected to said end wall by a neck and projects outwardly from said end wall into said seal opening;

said neck located in an outer region of the third groove section, wherein said outer region of the third groove section is reduced in height relative to the inner region of the third groove section such that said central retention boss is resiliently captured in said inner region of the third groove section.

17. The ram seal assembly as set forth in claim 16, wherein said first seal section, said second seal section, said central retention boss, and said first and second lateral retention bosses of said seal are defined as part of a one-piece molded elastomeric structure.

* * * * *